US005127177A

United States Patent [19]

Tanner

[11] Patent Number: 5,127,177

[45] Date of Patent: Jul. 7, 1992

[54] EXPANDABLE FRAME FACIA

[75] Inventor: James A. Tanner, Dublin, Ohio

[73] Assignee: Signstrut, Ltd., Amlin, Ohio

[21] Appl. No.: 542,914

[22] Filed: Jun. 22, 1990

[51] Int. Cl.[5] ..... G09F 17/00

[52] U.S. Cl. ..... 40/603; 160/328; 160/378

[58] Field of Search ..... 40/603, 604, 574, 576, 40/575, 610; 52/222, 28, 508, 273, 291; 160/328, 329, 372, 374.1, 375, 378; 38/102, 102.1, 102.91

[56] References Cited

U.S. PATENT DOCUMENTS

| | | | |
|---|---|---|---|
| 780,166 | 1/1905 | Foster | 160/392 |
| 974,600 | 11/1910 | Robinson | 160/379 |
| 1,867,565 | 7/1932 | Greenlee | 40/603 |
| 1,916,023 | 6/1933 | Shull | 160/374.1 |
| 3,485,165 | 12/1969 | Hughes | 160/395 |
| 3,934,365 | 1/1976 | Stein et al. | 40/603 X |
| 4,542,605 | 9/1985 | Gandy | 40/574 |
| 4,862,615 | 9/1989 | Hillstrom | 40/603 |
| 4,864,756 | 9/1989 | Rasmussen | 40/603 |

*Primary Examiner*—Peter R. Brown

*Assistant Examiner*—Brian K. Green

*Attorney, Agent, or Firm*—Colucci & Umans

[57] ABSTRACT

An expandable sign frame assembly for supporting a flexible membrane comprises a plurality of horizontally spaced vertically expanding section members having T-shaped cross sections. Brackets are slidably mounted near the top and bottom end of the section members and on opposite sides of an upstanding leg of the T-shaped cross section. Tensioning supports are connected at the top and bottom ends of the section members for receiving tensioning bolts which are threaded to flanges of the brackets. A channel extends along and is connected to the upper and lower brackets for capturing the upper and lower edge areas of a membrane which is to be tensioned between the brackets at the upper and lower ends of the section members. For a membrane that extends horizontally around the corner of a structure, horizontally around the corner of a structure, horizontal tensioning is achieved before vertical tensioning by pressing a vertical strip against the inside corner area of the membrane. Each channel includes a recess for capturing the edge area of the membrane, the edge area being wrapped around a membrane strip which is fixed in the channel recess.

4 Claims, 5 Drawing Sheets

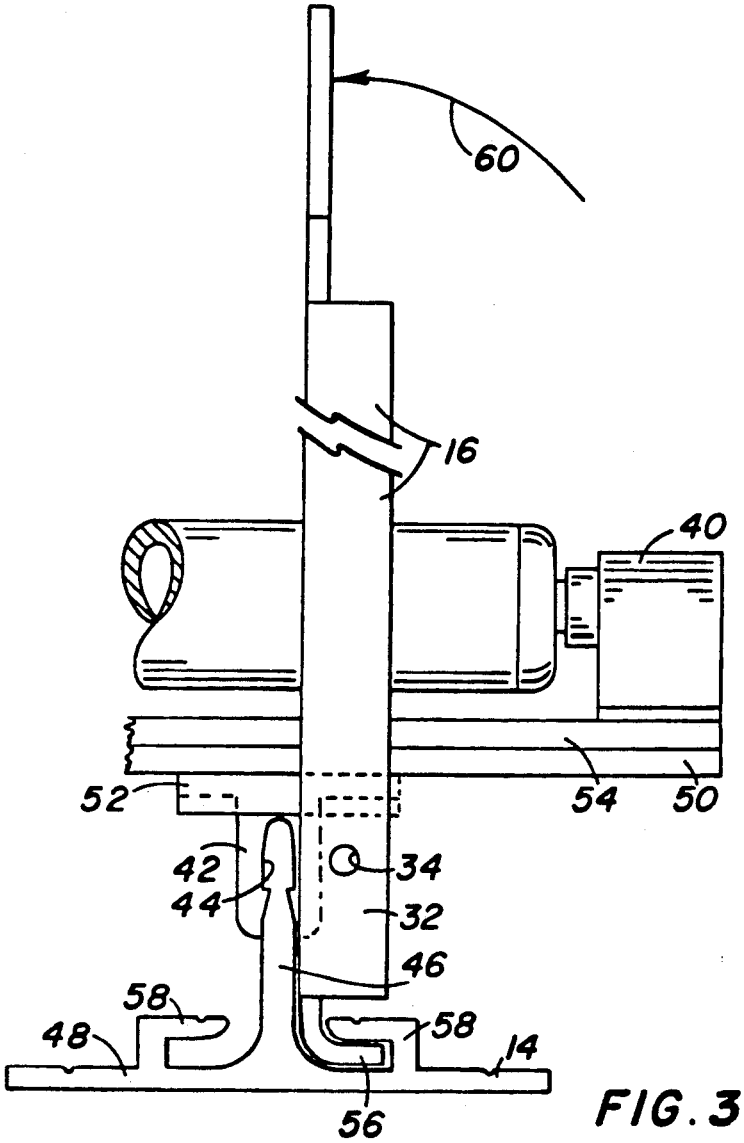
FIG. 3
FIG. 4
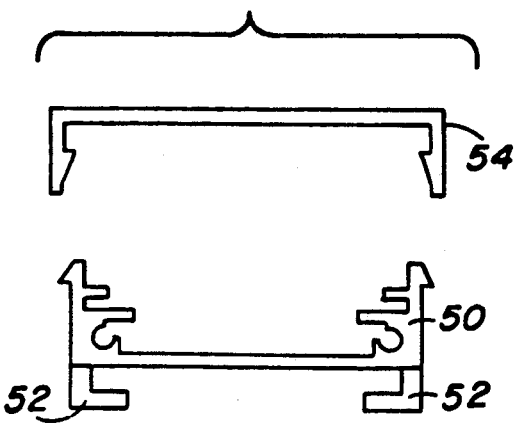

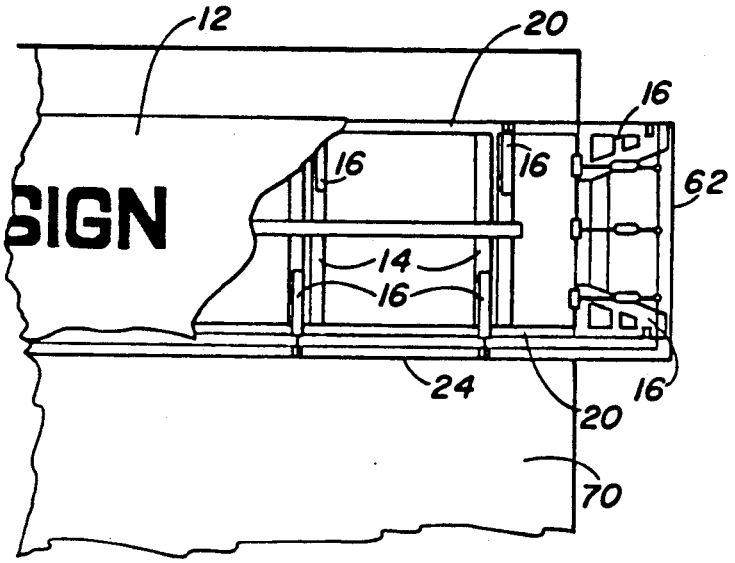
FIG. 5
FIG. 6
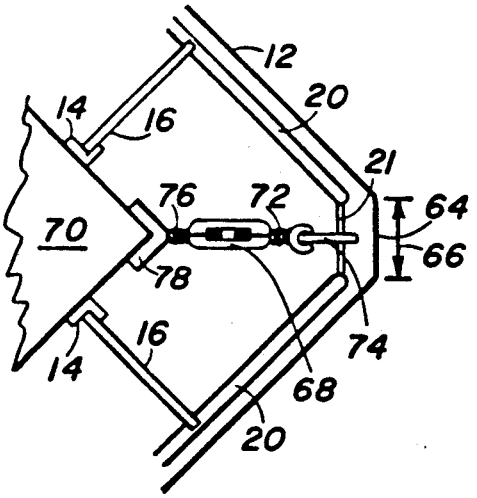
FIG. 7
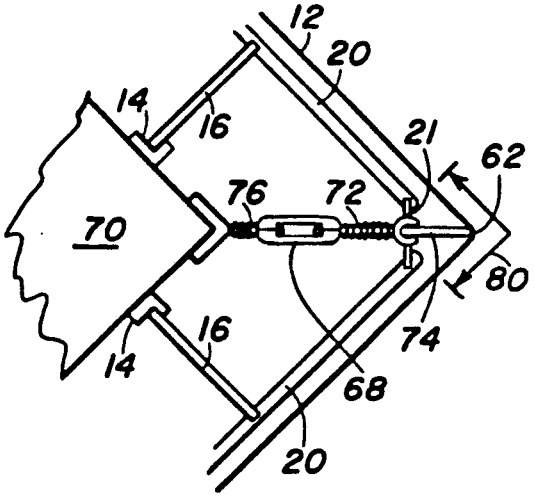

EXPANDABLE FRAME FACIA

FIELD AND BACKGROUND OF THE INVENTION

The present invention relates in general to the construction of signs which utilize flexible membranes to carry the display surface of the sign, and in particular to a new and useful facia which utilizes an expandable frame and other improved features to economically and effectively support and tension a flexible membrane to be used as a sign.

The use of flexible yet durable membranes in the construction of signs has been steadily increasing as the mechanisms for supporting and tensioning the flexible membranes have improved.

The tensioning of the sign membrane must be firm and secure since the sign must be exposed to weather and wind over long periods of time. It is also important that the membrane can be mounted in a quick and easy fashion not only for initial installation but also if and when the membrane is to be changed. A variety of mechanisms are known for grasping and holding the edges of the membranes and for tensioning these edges so that the membrane can be stretched on a frame.

Other considerations include the provision of sufficient space behind the sign for illumination, where the sign is to be illuminated, and the use of a mechanism for allowing the sign to extend around the corner of a structure in a continuous fashion where needed.

U.S. Pat. No. 2,899,764 to Oberlin, Jr. discloses a sign structure which is mounted on a vertical post by brackets which are spaced above and below the sign surface and are fixed around the post. The sign surface is tensioned vertically by turnbuckles which are connected between an edge of the sign and the bracket that is fixed, in turn, to the post. This reference does not include brackets that are slidably mounted along a section member, nor channels connected to ends of the brackets which are spaced away from the section member.

U.S. Pat. No. 3,537,201 to Huey et al. also uses vertically extending posts to support the upper and lower edges of a flexible sign membrane, but no tensioning mechanism is provided for moving the supports on the vertical posts to tension the membrane.

Another mechanism for tensioning a banner shaped sign is disclosed by U.S. Pat. No. 3,824,724 to Miller et al. which fixes one end of the banner to a vertical post and an opposite end of the banner to a spring loaded plunger. A sleeve for receiving the spring loaded plunger is also fixed to the post and vertical tensioning is provided by the spring loaded plunger. No bracket is disclosed which is slidably mounted to a section member and which is fixed to an edge of the banner so that sliding movement of the bracket through a tensioning element causes tensioning of the banner.

Transverse (horizontal) tensioning is disclosed by U.S. Pat. No. 4,459,773 to Sandlin et al.

Pivotally mounted brackets are used to tension upper and lower edges of a sign membrane in U.S. Pat. No. 4,833,805 to Roberson.

U.S. Pat. No. 4,864,756 to Rasmussen discloses a flexible enclosure which has upper and lower edges to which the upper and lower edge areas of a membrane are fixed. Vertical supports having one displacable end are used in connection with a bolt for spreading the inside of the enclosure to thus tension the membrane. Hollow members containing a rod around which the membrane is wrapped is utilized by Rasmussen to tension inner and outer corner areas of the sign membrane, horizontally.

U.S. Pat. No. 4,441,469 to Dahl discloses a channel structure (FIG. 11 of the reference) which contains a strip around which an edge area of membrane is wrapped, a lower edge of the strip being forced into a recess of a channel to fix the web as the web is tensioned around an opposite edge of the strip. Dahl does not utilized teeth in the channel recess for fixing one end of the strip however.

U.S. Pat. No. 4,539,724 to Messerschmitt and U.S. Pat. No. 4,554,754 to Stilling disclose two other approaches for fixing the edge area of a flexible membrane in a channel.

SUMMARY OF THE INVENTION

The invention comprises a frame assembly having vertically extending spaced apart section members which each have a bracket slidably mounted at at least one end thereof. An edge channel which defines an edge of the frame and ultimately an edge of the facia, is connected to the bracket at an outer end thereof which is spaced away from the section member. A unique fastening system is used to fix an edge of a flexible membrane that will form the display area of the facia, to the edge channel. A tensioning support is fixed to an end of the section member and a tensioning mechanism such as a bolt threadably mounted to the bracket and rotatable in the tensioning support is utilized to slide the bracket along the section member and thereby tension the membrane. Another unique feature of the invention is the method and arrangement for tensioning the membrane in a horizontal direction, and specifically at a corner area of the facia, before vertical tensioning takes place using the brackets.

Accordingly, one objection of the present invention is to provide an expandable sign frame assembly for supporting a flexible membrane, comprising: a section member, a bracket slidably mounted to said section member for movement in a membrane tensioning direction, an edge channel defining an edge of the frame and connected to said bracket at a location spaced from said section member in a direction transverse to the membrane tensioning direction, membrane fixing means connected between an edge area of a flexible membrane to be supported by the frame assembly, and said edge channel, for fixing the membrane edge area to said edge channel, a tensioning support fixed to said section member, and tensioning means engaged between said support and said bracket for sliding said bracket in the membrane tensioning direction to tension a membrane supported by the frame assembly.

A further objection of the present invention is to provide a method of tensioning a sign membrane extending around a corner on a frame carried by a supporting structure, comprising: closely wrapping the membrane on the frame in one plane around the corner to form a hypotenuse of a triangle with a portion of the membrane at the corner, pressing an edge member against the portion of the membrane forming the hypotenuse, to slide and tension the membrane on the frame in the one plane and to form two sides of the triangle which are adjacent the hypotenuse at the corner with the portion of the membrane, and subsequently tensioning the membrane on the frame in a direction orthogonal to the one plane.

A still further objection of the present invention is to improve an apparatus for tensioning a sign membrane in a tensioning direction the improvement comprising: a channel extending along an edge area of the membrane in a sign edge direction which is transverse to the tensioning direction, said channel having an elongated recess with a side opening extending in the sign edge direction, the channel including a strip retaining lip partly covering the recess and bounding one edge of the side opening, and a strip capturing lip bounding an opposite edge of the side opening, the side opening having a selected width between its one edge and its opposite edge, teeth defined on said channel and in said recess adjacent said strip capturing lip, and a membrane strip in said recess, said membrane strip having a dimension transverse to the sign edge direction which is greater than the selected width of the side opening, the strip including a first portion lying against an inner surface of the strip retaining lip in said recess, and a second portion lying against the teeth and adjacent the strip capturing lip, the membrane edge area being wrapped around the strip in a direction extending first over said first portion and thereafter over said second portion of said strip with an edge of the membrane emerging from the second portion of the strip, tensioning of the membrane in the tensioning direction pulling the first portion of the strip with the membrane wrapped therearound against the inner surface of the strip retaining lip, an pressing the second portion of the strip with the membrane wrapped therearound against the teeth.

The present invention provides a sign frame assembly which can utilize a unique tensioning method and an improved mechanism for grasping an edge of the membrane, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 3 is a top plan view of a portion of the frame;

FIG. 4 is an exploded view of a raceway and cover used to connect lighting fixtures to the frame;

FIG. 5 is a partial side elevational view of an expandable frame facia in accordance with the present invention and a corner area of the structure;

FIG. 6 is a top plan view of FIG. 5, showing an initial stage in tensioning a flexible membrane on the expandable frame;

FIG. 7 is a view similar to FIG. 6 showing a subsequent step in the tensioning procedure;

DESCRIPTION OF THE PREFERRED EMBODIMENT

Figure 1:
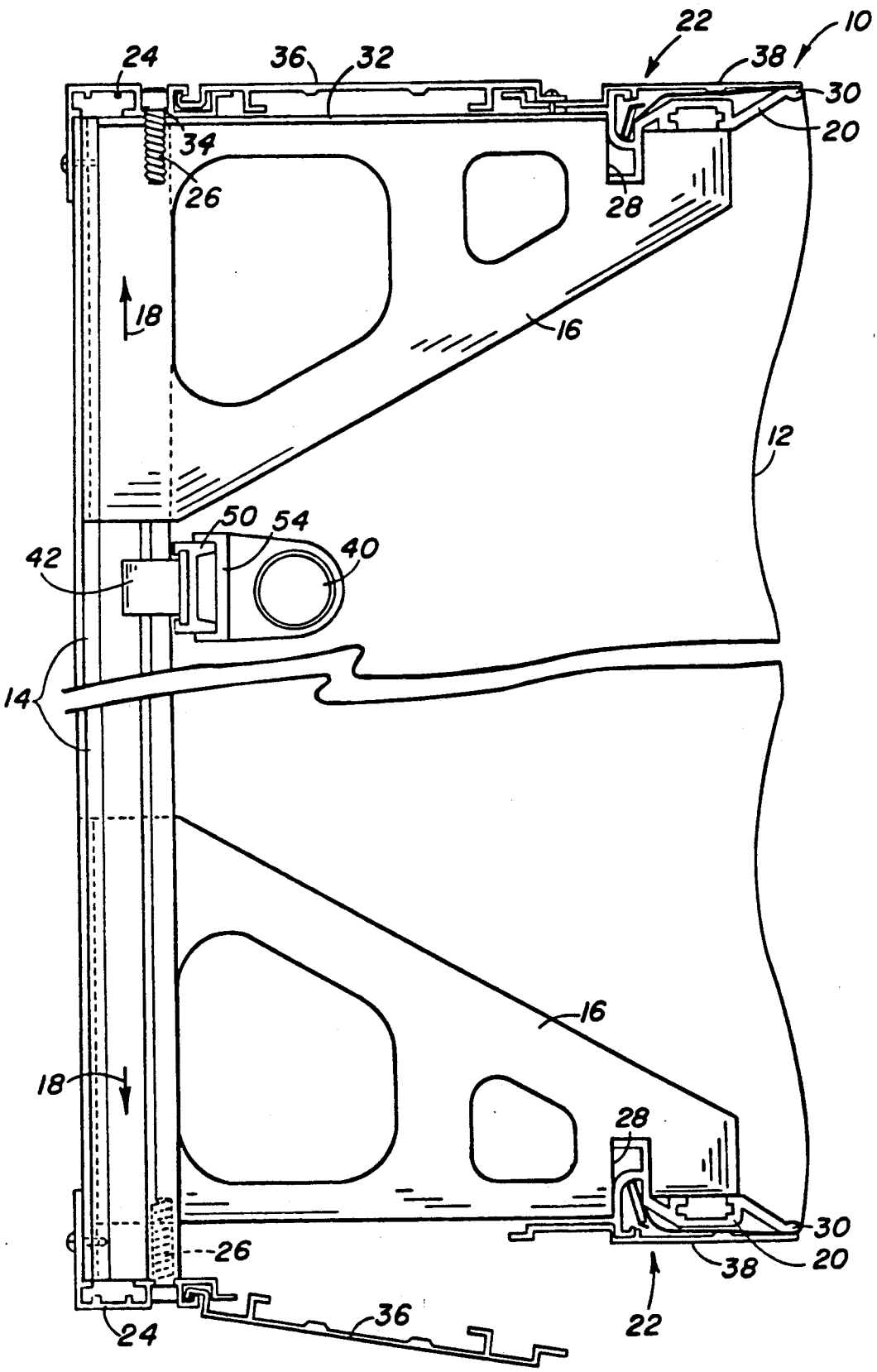
FIG. 1 is a side elevational view of an expandable frame facia in accordance with the present invention.

Referring to the drawings in particular, the invention embodied in FIG. 1 comprises an expandable frame assembly generally designated 10 for supporting and tensioning a flexible membrane 12 forming the indicia carrying or sign display portion of the facia. The frame assembly comprises a plurality of vertically extending section members 14, only one of which is shown in FIG. 1. The vertical section members 14 are spaced horizontally along the horizontal extent of the facia. Section members 14 are fixedly connected to a supporting structure such as a building, supporting framework or fixed posts, depending on the use for which the expandable frame is to be put.

A pair of brackets 16, 16 are slidably mounted to upper and lower ends of the section member 14, for movement in a membrane tensioning direction 18. The generally triangular brackets 16 are mounted on opposite sides of the section member 14. Each bracket 16 has an outwardly facing slot 28 which receives and holds an edge channel 20. Each edge channel 20 has an edge projection 30. With an edge channel 20 connected to each of the upper and lower brackets 16, edge projections 30 define the upper and lower edges of a display area of the membrane 12 which carries the indicia and which is visible after the membrane has been tensioned on the frame. Since slots 28 face opposite directions, channels 20 are automatically held to the frame between the brackets 16.

Membrane fixing means 22 are connected between respective upper and lower edge areas of the membrane 12, and respective edge channels 20, to fix the membrane to the edge channels.

A tensioning support in the form of a tensioning channel 24, is fixed to the upper and lower ends of section member 14, and defines a fixed frame of reference with respect to the movably mounted brackets 16. Tensioning means in the form of a tensioning bolt 26 extends through a hole provided in each tensioning support 24 and is engaged into a threaded bore 34 of a flange 32 of each bracket 16. In FIG. 1, upper bracket 16 is shown in a fully raised and seated position. This was achieved by rotating bolt 26 in threaded bore 34 until flange 32 engaged up under the tensioning support 24. The lower bracket 16 is shown in an untensioned condition with bolt 26 threaded into the flange of the bracket but with the membrane 12 not yet tensioned. In use, the upper bracket would be seated as shown, first and final tensioning would be achieved using the lower bracket. The upper and lower edge areas of the membrane are also shown in unseated conditions within each edge channel 20 in FIG. 1.

FIG. 1 also shows removable covers 36 and 38 which are used at the top and bottom of the assembly to form an enclosed facia structure. Cover 38 is shaped to cover the edge channel 20 and extend partly over the outer surface of bracket 16. Cover 36 engages an outer recess of tensioning channel 24 and spans the space between channel 24 and edge channel 20.

The lower portion of FIG. 1 shows cover 36 before it is engaged with and connected to cover 38. Since, in a final condition, the lower bracket 16 may not be pulled all the way to the bottom of section 14, cover 36 is designed so that it can extend at a slight angle to the horizontal and still meet with cover 38.

Figure 2:
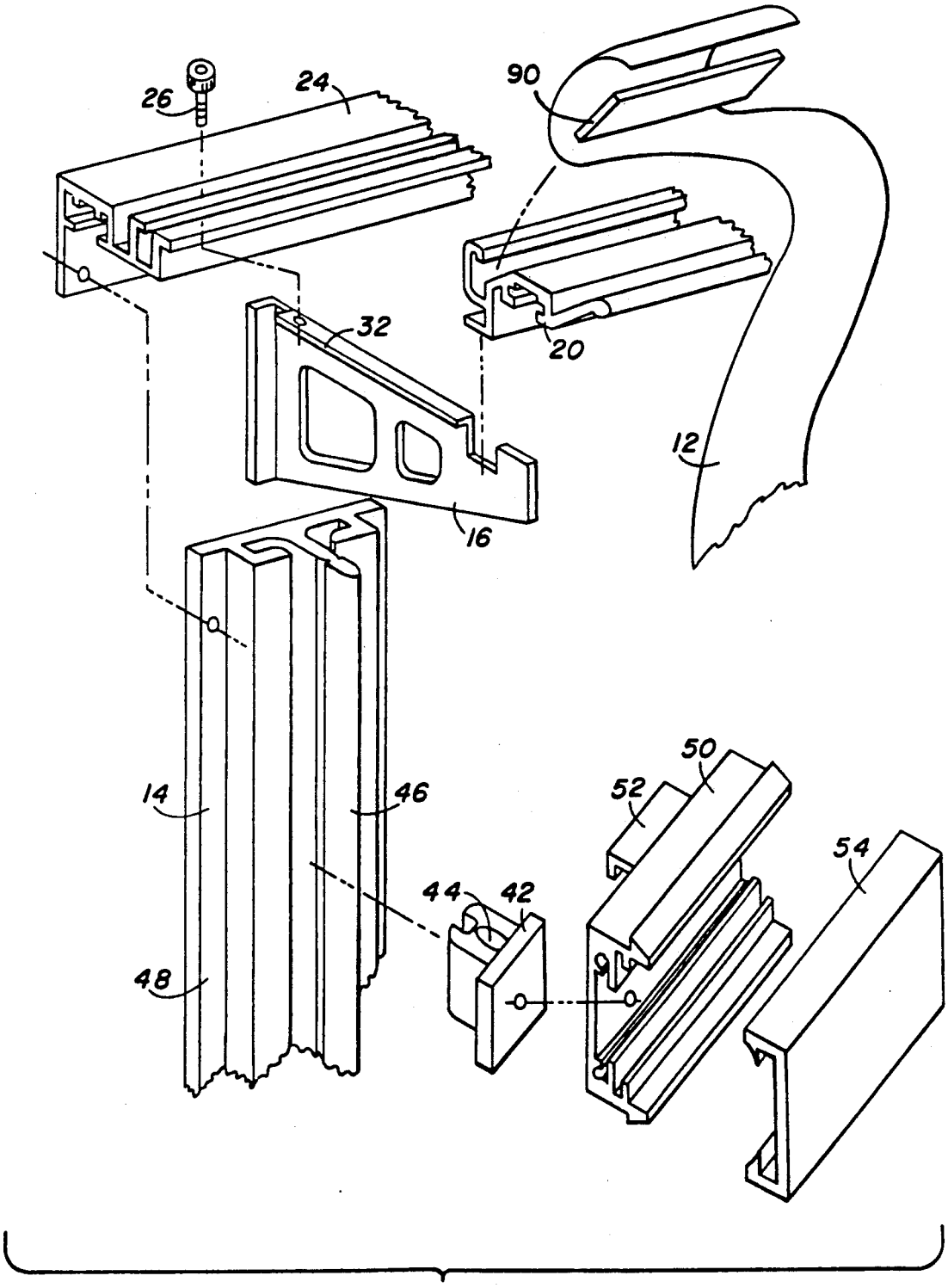
FIG. 2 is an exploded view showing the components of one section of the frame.

FIG. 1 also illustrates a mechanism for supporting a lighting fixture such as a fluorescent fixture 40 to the frame. As best shown in FIGS. 1 and 2, this structure comprises a clip 42 which defines a recess 44 shaped to receive an upstanding leg 46 of the T-shaped section member 14. Teeth in recess 44 engage recesses in the opposite sides of leg 46 to firmly hold the clip 42 to the section member 14 (see FIG. 3).

A raceway 50 (FIG. 4) is connected either by bolts or by upper and lower L-shaped jaws 52, to clips 42 which are mounted on each of the vertically extending and horizontally spaced section members 14. Raceway 50 which defines an inner base for receiving the wires of the fluorescent fixture 40, is covered against the weather by a cover 54 which is mounted to the raceway by snap action. Although FIG. 1 shows a single fixture 40, usually a minimum of two or more horizontally extending vertically spaced fixtures are utilized to illuminate the membrane 12 from inside the frame.

As best shown in FIGS. 2 and 3, each section member 14 has a pair of L-shaped jaws 58 on opposite sides of the leg 46, which project from the inner surface of a cross member 48 for the section member 14. Each bracket 16 includes a second flange 56 which extends perpendicularly to flange 32. Flange 56 is shaped to be retained by the jaw 58 on one side of the leg 46. The engagement of the bracket 16 to the section member 14 is either by vertically sliding the body into place (as illustrated in FIG. 2), or by hooking the flange 56 under the jaw 58, and rotating the bracket into position in the direction of arrow 60 in FIG. 3. This is advantageous when the upper and lower tensioning channels 24 have been previously installed onto the upper and lower ends of section member 14, for example by screws.

By positioning the upper bracket on an opposite side of the leg 46 from the lower bracket (FIG. 5), and because of the interconnection of the these brackets by the edge channels 20 and the membrane stretched thereacross, any tendency of the brackets to disconnect from their section members is precluded. FIG. 5 illustrates a larger section of the frame where two section member 14 are visible behind a cutaway section of membrane 12. FIG. 5 illustrates the mounting of brackets 16, 16 on opposite sides of the section member, and also illustrates a corner area 62 of a facia which is spaced away from and wrapped around a corner of a supporting structure such as a building 70.

In accordance with the present invention, the horizontally elongated membrane 12 is first stretched in a horizontal plane before it is stretched in a vertical direction using the brackets 16. Horizontal tensioning is achieved by first wrapping the membrane 12 closely around the corner area and by anchoring far edges of the membrane (not shown) by any conventional means. Where the facia engages entirely around the structure or building 70, the opposite edges of the membrane material which may be heavy gage vinyl, are spliced to each other to snugly engage the membrane on the frame.

Since channels 20 do not extend all the way to corner 62, a portion 64 of the membrane at the corner forms the hypotenuse 66 of an imaginary triangle which will ultimately form the corner 62 of the facia. Since the heavy gage flexible membrane 12 is selected to have limited stretching ability, normally on the order of 1/16th of an inch per foot, a relatively small amount of tensioning in the horizontal plane is necessary to fully stretch and tension the membrane sign material 12. To achieve this, the invention utilizes a turnbuckle 68 which is connected on one side to a first bolt 72 which is connected by a shackle to a vertically extending edge strip 74, and a second bolt 76 which is fixed to an angle member 78 pressed against a corner of building 70. By turning turnbuckle 68, bolts 72 and 76 are spread apart, thus thrusting the edge strip 74 against the inner surface of membrane portion 64. This pushing action is braced against the corner of building or structure 70 and forms two sides 80 of the triangle which have a mathematically increased extent in the horizontal plane over the hypotenuse 66. This increased effective length, tensions the membrane 12 in the horizontal plane and can add 3 to 4 inches of effective length to the membrane. Channels 20 are held apart by a splice plate 21 at the corner area.

Only after this horizontal tensioning, are the tensioning bolts 26 turned to tension the membrane in the vertical direction, or orthogonally to the horizontal plane.

Figure 8:
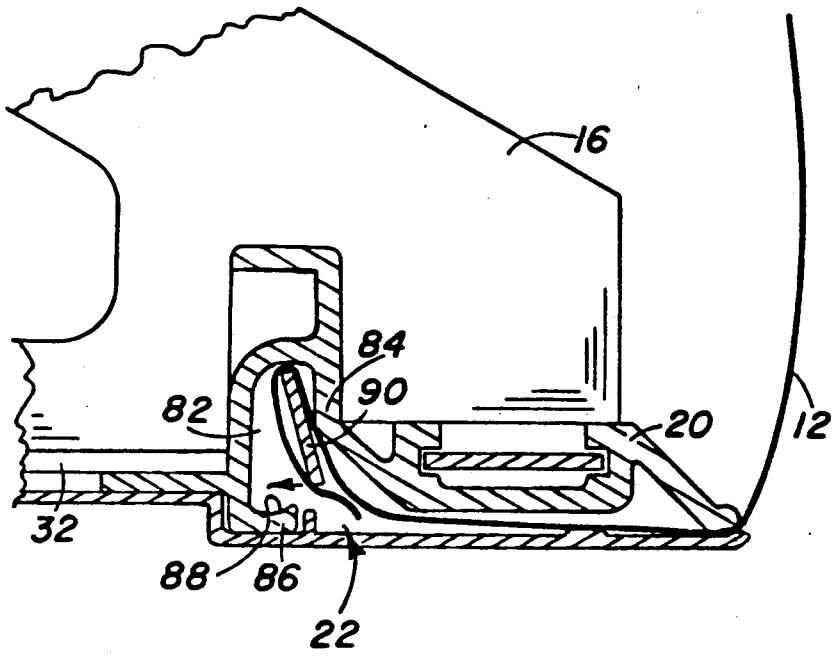
FIG. 8 is a sectional view, on an enlarged scale, showing means for fixing an edge area of the flexible membrane to a slidably mounted bracket of the frame, before the membrane is fixed to the frame.
Figure 9:
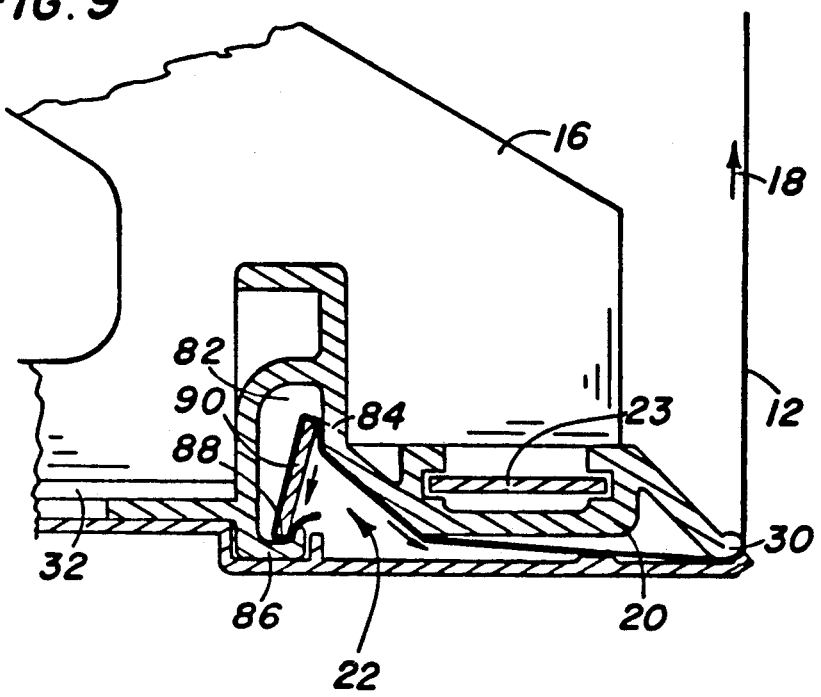
FIG. 9 is a view similar to FIG. 8 showing the membrane in a fixed and tensioned condition.

FIGS. 8 and 9 illustrate the fixing means for the edge area of the membrane 12. FIG. 8 corresponds to the position of the edge areas in FIG. 1. FIG. 9 shows the position of the fixing means after the edge area has been fixed and the membrane 12 has been fully tensioned. The fixing means comprises a recess 82 which is formed in edge channel 20. Channel 82 has a side opening which is bounded at the top in FIG. 9 by a strip retaining lip 84 an at the bottom by a strip capturing lip 86. Teeth 88 are defined on the inner surface of lip 86 and are structured to be able to bite into the membrane material 12 as well as the material of a membrane strip 90.

With the edge area of the membrane 12 wrapped over the membrane strip 90, and with the wrapping extending firstly over an upper portion of the strip and then around a lower portion of the strip, the strip is slipped into the recess 82 and swung over the teeth of lip 88. To this end strip 90 has a width transverse to the sign edge direction (along 30) which is slightly greater than a selected width of the side opening of recess 82. This allows the wrapped strip 90 to be placed in the recess easily.

In this position, when membrane 12 is tensioned in the tensioning direction 18, force is applied to the strip 90 in the direction of the arrows in FIG. 9, to swing the upper portion of the strip outwardly against the inner surface of lip 84. Simultaneously, the wrapping direction of the membrane material presses the strip 90 downwardly into the teeth 88 to firmly fix the strip and the membrane in position.

FIG. 9 also illustrates a splicing plate 23 that is engaged in a keyway formed by channel 20 to splice lengths of channel together.

The present invention is particularly useful for illuminated membrane signs since sufficient space is provided within the expandable frame for lighting fixtures and, even more importantly, the expandable frame of the invention places no solid obstacles between the source of light and the rear surface of the membrane. This is important since any solid object in this area would cast an unsightly shadow which would be visible from the front of the illuminated sign.

The tensioning method illustrated in FIGS. 6 and 7 can also be applied to other structures for vertically tensioning the membrane, other than that disclosed in FIGS. 1 through 5. In likewise fashion, the anchoring structure shown in FIGS. 8 and 9 for anchoring the edge area of the membrane can be used in other tensioning arrangements for the membrane.

While specific embodiments of the invention have been shown and described in detail to illustrate the application of the principles of the invention, it will be understood that the invention may be embodied otherwise without departing from such principles.

What is claimed is:

1. An expandable sign frame assembly for supporting a flexible membrane, comprising:

a section member;

a bracket slidably mounted to said section member for movement in a membrane tensioning direction;

an edge channel defining an edge of the frame and connected to said bracket at a location spaced from said section member in a direction transverse to the membrane tensioning direction;

membrane fixing means connected between an edge area of a flexible membrane to be supported by the frame assembly, and said edge channel, for fixing the membrane edge area to said edge channel;

a tensioning support fixed to said section member; and tensioning means engaged between said support and said bracket for sliding said bracket in the membrane tensioning direction to tension a membrane supported by the frame assembly;

said bracket being slidably mounted to said section member near one end of said section member;

an additional bracket connected to said section member at an opposite end of said section member;

further membrane fixing means connected between said additional bracket and an opposite edge area of a flexible membrane to be supported by the frame assembly, so that the flexible membrane is tensioned between said first mentioned and said additional brackets along said section member; and said section member having a T-shaped cross section including a cross member and an upstanding leg, said first mentioned and additional brackets being mounted to said section member on opposite sides of said upstanding leg.

2. An assembly according to claim 1, wherein said section member includes an L-shaped jaw on said cross member one each side of said upstanding leg for defining a flange receiving recess on each side of said upstanding leg, each bracket having a flange received in one recess of said section member.

3. An assembly according top claim 2, wherein said first mentioned bracket includes a second flange, said tensioning means comprising a bolt engaged with said second flange.

4. An assembly according to claim 1, including a fixture supporting clip including a pair of jaws defining a recess for engaging the upstanding leg of each section member, a fixture raceway connected to each clip and a raceway cover engaged to and covering said raceway, said raceway and raceway cover being adapted to support a lighting fixture on said section members.

* * * * *